US006378422B1

(12) United States Patent
Czachor

(10) Patent No.: US 6,378,422 B1
(45) Date of Patent: Apr. 30, 2002

(54) ROTARY MARKING DEVICE

(75) Inventor: Edward P. Czachor, Hendersonville, NC (US)

(73) Assignee: Robert P. Czachor, Cincinnati, OH (US)

( * ) Notice: Subject to any disclaimer, the term of this patent is extended or adjusted under 35 U.S.C. 154(b) by 0 days.

(21) Appl. No.: 09/705,278

(22) Filed: Nov. 3, 2000

(51) Int. Cl.[7] ..... B41J 1/22; B41J 47/46

(52) U.S. Cl. ..... 101/93.18; 101/93; 101/91; 101/41

(58) Field of Search ..... 101/93.19, 93.24, 101/93.18, 41, 91

(56) References Cited

U.S. PATENT DOCUMENTS 2,510,350 A * 6/1950 Rouan et al. ..... 101/91
4,160,410 A * 7/1979 Fichter ..... 101/41
4,436,031 A * 3/1984 Hori ..... 101/93.17
5,372,065 A * 12/1994 Cuozzo et al. ..... 101/93
5,445,074 A * 8/1995 Malin et al. ..... 101/91

* cited by examiner

*Primary Examiner*—Andrew H. Hirshfeld
*Assistant Examiner*—Marvin P Crenshaw

(57) ABSTRACT

A rotary marking device for use in a multi-spindle screw machine to mark a rotating work piece. The marking device has a rotating marking wheel with marking indicia on a portion of its circumfrence. When the marking device is in marking position adjacent the rotating work piece a rack and pinion operates to initiate the rotation of the marking wheel in its rotating marking direction.

14 Claims, 3 Drawing Sheets

ROTARY MARKING DEVICE

CROSS-REFERENCE TO RELATED APPLICATIONS (Not Applicable)

STATEMENT REGARDING FEDERALLY SPONSORED RESEARCH OR DEVELOPMENT (Not Applicable)

REFERENCE TO A MICROFICHE APPENDIX (Not Applicable)

BACKGROUND OF THE INVENTION

Prior Art

A preliminary search has been made with the result of finding the following pertinent art.

| | | |
|---|---|---|
| 2,974,583 | March 14, 1961 | Friedman |
| 2,996,977 | August 22, 1961 | Friedman |
| 3,019,724 | February 6, 1962 | Hoffmann |
| 3,788,943 | June 15, 1965 | King et al |

This invention relates to a marking device which is used primarily in a multi-spindle screw machine to mark a rotating work piece which is being formed in the screw machine. When a work piece is finished it is desirable to mark it with identifying printing or other types of markings which may be impressed into the work piece. The marking device which has a rotating marking wheel and marking indicia on its periphery is mounted in the multi-spindle screw machine and is moved by the screw machine between a marking position and a non-marking position on the screw machine. When in the marking position the marking wheel engages the work piece and rotates with the work piece to imprint the markings on the work piece.

In the prior art when the marking device is in position to mark the work piece, starter buttons on the marking wheel engage the work piece and this initiates the rotation of the marking wheel and then the marking indicia engage the work piece and the marking wheel is rotated through the marking operation.

The abrupt rotational start of the marking wheel by the engagement of the starter buttons with the work piece will often cause scratching or improper marking of the work piece and the work piece will have to be scrapped. Also, with the starter buttons it is difficult to adjust and control the depth of the impression of the markings in the work piece and because of adjustment of and wear on the starter buttons the marking wheel needs to be replaced frequently.

BRIEF SUMMARY OF THE INVENTION

This invention relates to a marking device which is employed to imprint an impression or some type of marking on a rotating work piece. The marking device has a rotating marking wheel that, when the device is in proper marking position adjacent the work piece to be marked, the marking wheel is set in rotary motion prior to contact of the marking wheel with the work piece and the indicia on the marking wheel then contacts the work piece. The required marking is thereby imprinting on the work piece.

The principal object of this invention is to provide a marking device of novel and improved construction, whereby, rotation of the marking wheel is initiated within the marking device and the rotation of the marking wheel and the rotation of the work piece are substantially synchronized prior to the engagement of the marking wheel indicia with the work piece.

An additional object of this invention is to provide a marking wheel which is biased in the opposite direction of rotation than the marking wheels of the prior art. More specifically, in the prior art the marking wheel is rotationally biased in the return rotary direction by operation of the contact of the marking wheel with the work piece and thereby a spring is stressed or tensioned and the marking wheel is latched in a biased position until the marking device is moved away from the work piece and the latch on the wheel is released to reverse the rotation of the marking wheel so that it returns to its pre-marking position. In the present invention the return of the marking device moves the rack forward thereby reversing the rotation of the marking wheel and biasing the marking wheel for rotation in readiness for imprinting the next work piece.

A basic or fundamental object of this invention is to provide a rotary die marking unit wherein the rotary marking wheel is set in motion prior to the marking wheel making contact with the work piece and thereby reducing the likelihood of producing a defective mark on the work piece. In accomplishing this object of the invention, in one mode, there is provided a biased rack with a latch to hold it in cocked position. The rack has teeth which engage teeth of a pinion. The pinion and the marking wheel are rotatably connected. When the latch on the rack is released, the rack is driven linearly by the force of the biasing means. The teeth on the rack engage the teeth on the pinion, thereby initiating the rotation of the marking wheel. The work piece to receive the marking is rotating at a particular speed and it is an object of this invention to start the rotation of the marking wheel prior to the contact of the marking wheel with the work piece, so that as the two come into contact for the impression to be made on the work piece, the marking wheel is rotating at substantially the same speed of rotation as the work piece. In this way there is no abrupt rotational start of the marking wheel when it contacts the work piece, as in the prior art.

Therefore, it is an important feature of this invention that the marking wheel requires no starter buttons, since the device has its own mechanism to initiate the rotation of the marking wheel. Thereby, the rotation speed of the marking wheel and the work piece are substantially synchronized at the time the two come into contact with each other when the work piece is marked.

An advantage of this invention is that it provides a marking device whereby the depth of the impression of the print or mark can be controlled by adjusting the forward position of the marking device. This will thereby provide a constant and uniform depth of impression each time a mark is made without any other type of adjustment of the body or marking wheel for a particular job. Since the forward working position of the marking device is the only adjustment necessary for a work piece job run, much time will be saved, because of less down time for adjustments and the marking wheel as well as its indicia will last much longer than in the prior art.

Additionally this device requires no special design of starter buttons on the marking wheel or "bump cams" to move the device to its final position for the marking operation, as in the prior art. An early no rise cam is all that is utilized, as is know in the prior art, for positioning the device adjacent the work piece prior to the marking operation and only one early no rise cam is required.

DETAILED DESCRIPTION OF THE INVENTION

Figure 1:
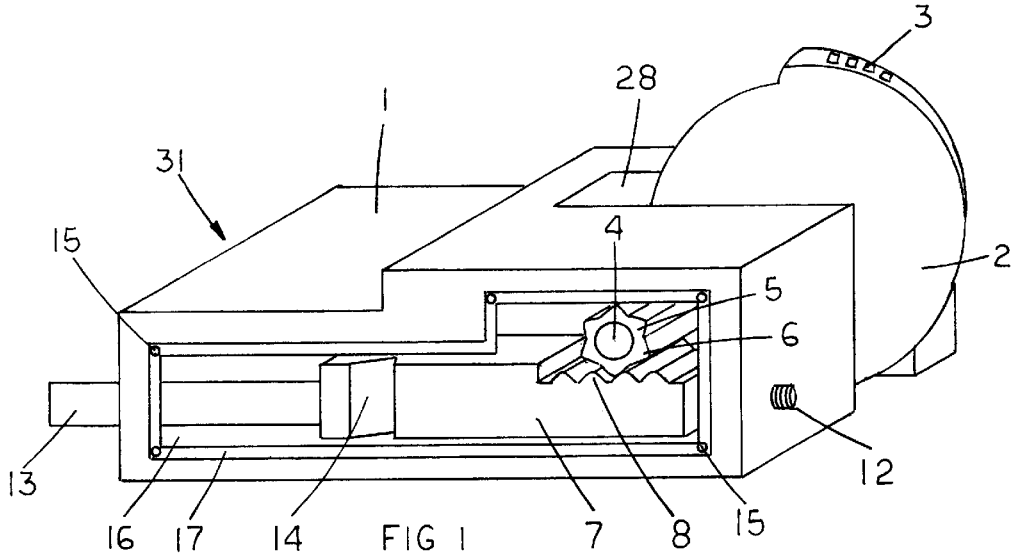
FIG. 1 A perspective view of the marking device.
Figure 2:
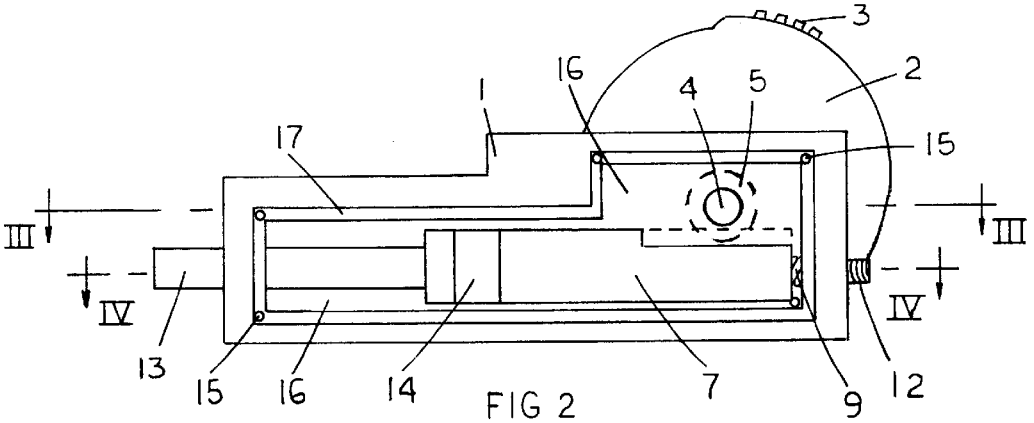
FIG. 2 A side view of the marking device.

In the drawings, FIG. 1, shows the marking device 31 having a body 1, a cavity 16 in the body 1, screw holes 15 for screws to fastening the cover 18 (FIGS. 4 and 5) to the body 1. Slidably positioned within the cavity 16 is a rack 7. The rack 7 has on one end an extension 13 and rack gear teeth 8 on the top of the other end. At the side of the rack 5 is a latch groove or notch 14 formed in the rack 7. At the forward end of the body is a slot 28 forming a vertically bifurcated portion with a marking wheel 2 mounted therein. On the marking wheel are letters, numbers or some other type of raised indicia 3 on at least a portion of the periphery of the wheel 2.

Figure 3:
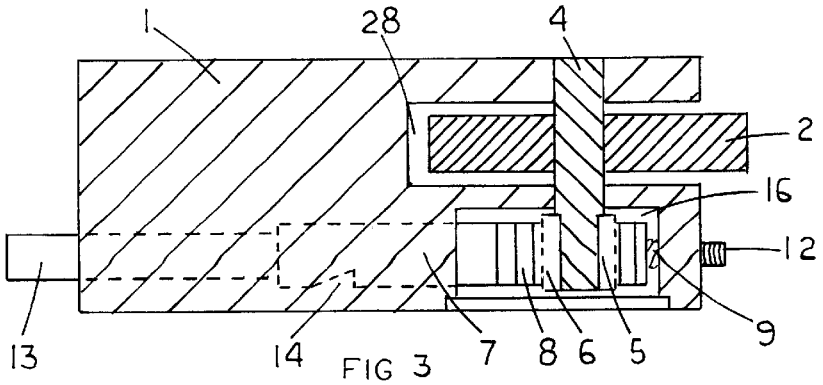
FIG. 3 A section of the marking device taken at III—III of FIG. 2.

Referring to FIGS. 1 and 3 the marking wheel is mounted on a shaft 4. The shaft 4 extends through bores in the bifurcated portions of the body 1 and one end of shaft 4 extends into the cavity 16. Mounted on the end of the shaft is a pinion gear 5 having gear teeth 6 thereon which mess with gear teeth 8 on the rack.

Figure 4:
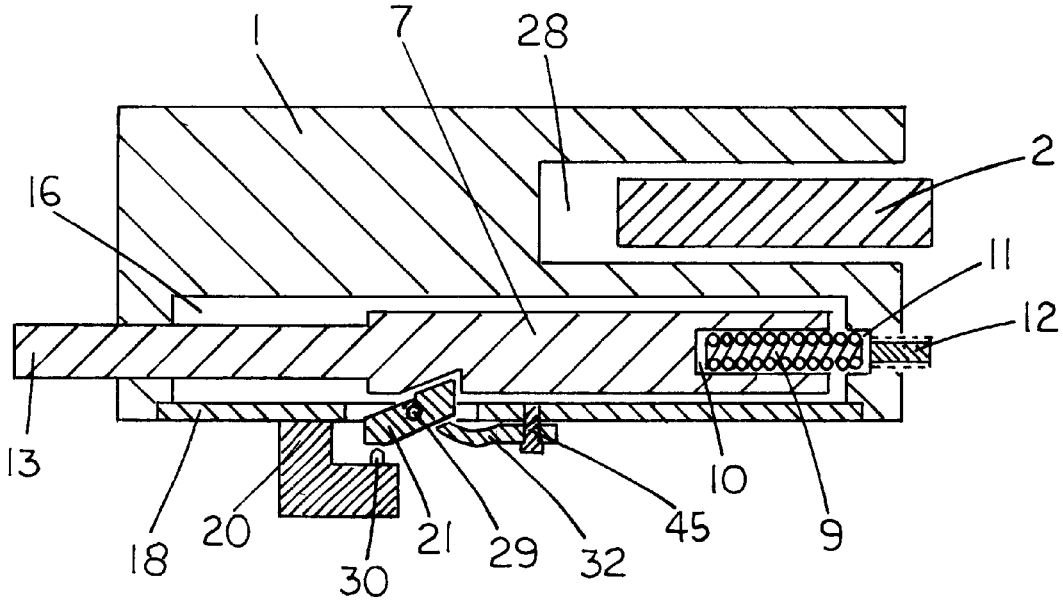
FIG. 4 A section of the marking device taken at IV—IV of FIG. 2.
Figure 5:
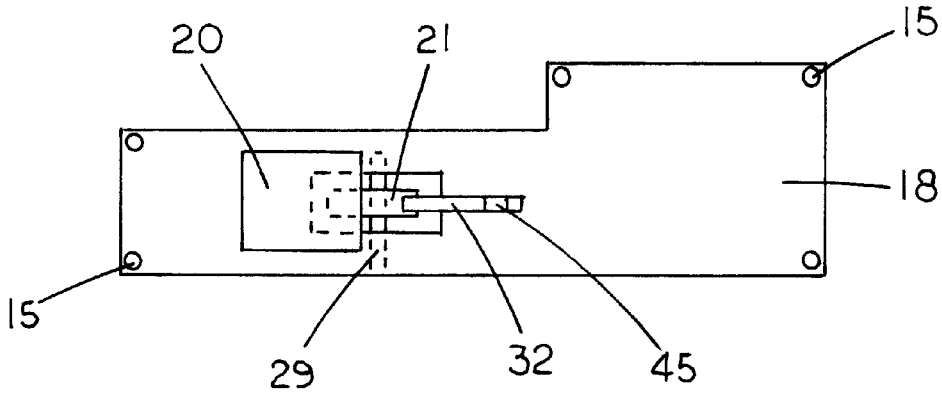
FIG. 5 A view of the cover and latch.

In FIGS. 4 and 5, the cover 18 has a latch 21 which is pivotally mounted on pivot pin 29. The latch 21 has an inwardly extending portion for engagement with the latch notch 14 in the rack 7. The inward extending portion of the latch 21 is biased inwardly toward the rack 7 by means of a strap spring 32 so that the inwardly extending portion of the latch engages the notch 14. Also mounted on the cover 18 is a solenoid 20 with a solenoid plunger 30 for engagement with the latch 21 to pivot the latch 21 to release position when the solenoid is operated. The rack 7 has a bore 10 at the forward end an positioned in the bore is a compression spring 9. The other end of the spring extends into a bore 11 in the body 1 and the bore 11 has a smaller threaded bore wherein there is positioned a spring tension adjusting screw 12.

One mode of operation of the present invention is to mount the marking device 31, containing all of the elements for rotating the marking wheel, on the cross feed of a multi spindle screw machine. This cross feed of a multi spindle screw machine provides a horizontal forward and backward movement of the device 31. With the multi spindle screw machine in operation and when it is time to mark the work piece, the cross feed moves the marking device 31 forward to a stop on the cross feed so that the marking wheel 2 is at the position to mark the work piece. When the work piece in the screw machine is rotated to the marking position an electrical impulse, actuates the solenoid 20 and the solenoid plunger 30 contacts the latch 21 pivoting it to release position and thereby release the biased rack 5. The spring 9 forces the rack 7 to move rapidly to its rearward position. This movement rotates the pinion 5 and the rotation of the marking wheel 2 is initiated. The indicia 3 on the marking wheel rotatable engage the rotating work piece and imprints the markings thereon.

The speed of rotation of the marking wheel 2 depends on the compression strength of the spring and amount of adjustment of the adjusting screw 12. If it is desired to increase the rotational speed of the marking wheel 2 a stronger spring may be used or the screw 12 can be adjusted to increase the compression of the spring. Also, a weaker spring or adjustment of the screw 12 can be used to decrease the rotational speed of the marking wheel 2. As should be readily apparent, the rotational speed of the marking wheel of this invention can be adjusted so that at the time of the marking contact of the marking wheel with the work piece the rotational speed of the marking wheel and the work piece will be substantially the same and a more precise marking of the work piece will be obtained than with the prior art devices.

Figure 6:
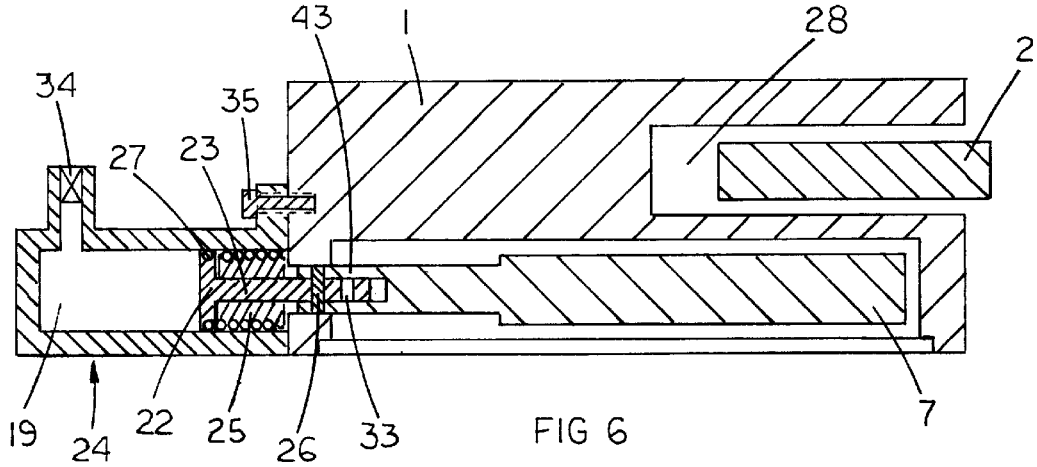
FIG. 6 A modification of the marking device shown in section substantially as shown in FIG. 3.

FIG. 6 shows a modification of the marking device which has a fluid and spring combination operated device 24 attached to the body 1 with a bolt 35. The device 24 has a fluid chamber 19 which is pressured with fluid through valve 34. In the bore 19 is positioned a piston 22 with an O-ring 27 sealing the piston with the wall of the fluid chamber 19. The piston 22 has a piston rod 23 extending into a bore 43 of the rack 7. The piston rod 23 and the rack 7 each have a matching vertical bore therethrough in which is positioned a pin 26 to connect the piston rod to the rack 7. The piston rod has another vertical bore 33 whereby the position of the piston rod 23 can be adjusted with respect to the rack 7. Positioned between the piston 22 and the body 1 is a spring 25. When the fluid chamber 19 is pressured it forces the piston 22 to compress the spring 25 and the rack 7 is moved to its forward position and the marking wheel 2 is rotated to its pre-marking position. When the marking device is moved by the cross feed of a screw machine to its marking position and the work piece is in position to be marked the fluid in chamber 19 is released through valve 34 and the spring 25 forces the piston 22 along with the rack 7 rearwardly and the marking wheel 2 is rotated to mark the rotating work piece.

Figure 7:
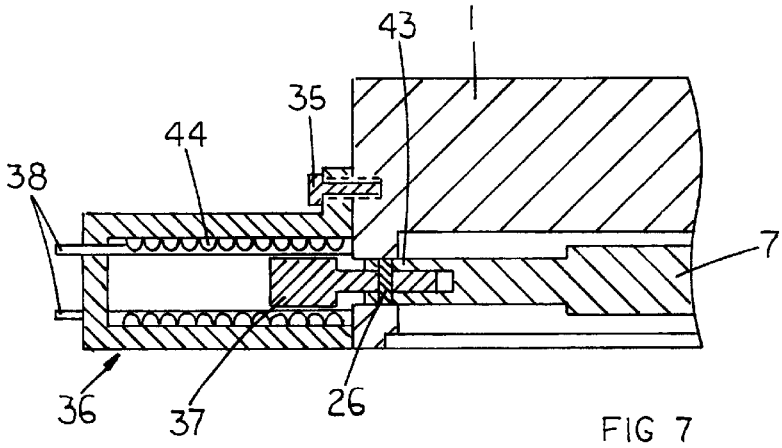
FIG. 7 A second modification of the marking device shown in section substantially as shown in FIG. 3.

FIG. 7 shows another modification wherein a solenoid device 36 is attached to the body 1 by bolt 35 and the solenoid is utilized to move the rack 7 in both the forward and rearward directions. In this construction there is shown a solenoid coil wiring 44, electrical contacts 38, solenoid plunger 37 extending into the bore 43 in the rack 7 and a pin 26 attaching the solenoid plunger 37 to the rack 7. In this modification when the marking device 31 is in position to mark the work piece the solenoid is operated to move the solenoid plunger 37 in a rearward direction which in turn moves the rack 7 in the same direction and thereby initiating the rotation of the marking wheel 2 in its rotating marking direction. After the marking device 31 is moved to its non-marking position the solenoid is operated to move the plunger 37, the rack 7 and the marking wheel 2 back to their pre-marking position.

Figure 8:
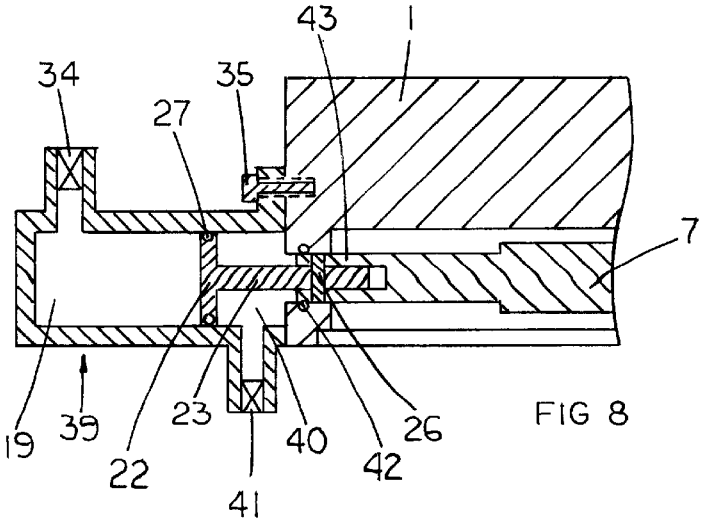
FIG. 8 A third modification of the marking device shown in section substantially as shown in FIG. 3.

The modification in FIG. 8 shows a fluid operated device 39, that has a fluid chamber 19 which can be charged through a valve 34. There is a piston 22 with an O-ring 27 positioned in the chamber 19. The piston 22 has a rod 23 which extends into a bore 43 in the rack 7. A pin 26 connects the rod 23 to the rack 7, and an O-ring 42 seals the rod 23 to the body 1. At the rod side of the piston 22 is a fluid bias chamber 40 which is pressured through the valve 41. To prepare this device for marking a work piece the chamber 19 is pressurized to move the piston 22 and thereby the rack 7 forward to the pre-marking position and the marking wheel 2 is simultaneously rotated to its pre-marking position. The pressure chamber 40 is pressurized and when the marking device is ready to mark the work piece the pressure is released from chamber 19 through valve 34 and the piston moves to its rearward position carrying the rack 7 with it and rotating the marking wheel through its marking operation. The pressure in the chamber 40 can be varied so that the desired speed of rotation of the marking device can be achieved.

The marking device herein illustrated is particularly adaptable for use on a cross slide of a multi spindle screw machine, such as, Acme Cleveland, Cone Automatic, Warner Swasey, New Britain, Gildermeister and the like. As is apparent to those in the trade, this tool can be readily adapted for use on any of the plural spindle screw machines as found in the trade where it is desired that work pieces be impressed with a marking of some type and particularly with printed matter.

I claim:

1. A marking device of the character described for use in a multi-spindle screw machine, the device having a body, said body having a forward end and a rearward end, a slot in the forward end of the body, a shaft mounted in the slot, a marking wheel mounted on the shaft, a pinion with gear teeth thereon on one end of the shaft, a cavity in the body, a rack slidable mounted in said cavity, the rack having teeth thereon in engagement with the gear teeth on the pinion, one end of the rack extending outwardly of the rear part of the body, the other end of the rack having biasing means biasing the rack toward the rear of the body, the rack having a latch engaging means thereon, a latch means, said latch means having a part biased inwardly toward the rack and having an engaging portion for engagement with the latch engaging means of the rack, the latch having an engaging position holding the rack in forward biased position and a release position for disengagement from the rack, means associated with the biasing means for adjusting the biasing force of the biasing means, whereby when the rack is moved to its forward position the rack teeth rotates the pinion and thereby the printing wheel in one direction to its starting position and said latch engages said rack, holding said rack in said forward position, the force of said biasing means being increased and biasing said rack toward its rearward position, means to move said latch to its release position, whereby the biasing means forces the rack to its rearward position and initiates the rotation of the marking wheel in its marking direction.

2. The apparatus as claimed in claim 1 wherein said latch is operated electrically.

3. The apparatus as claimed in claim 1 wherein said biasing means is a spring.

4. The apparatus as claimed in claim 1 wherein said biasing means has means to adjust said biasing force.

5. A marking device of the character described for use in a multi-spindle screw machine, the device having a body, a slot in the body, a shaft mounted on the body and extending through said slot, a marking wheel mounted on the shaft, indicia on said marking wheel, a pinion on one end of the shaft having at least one gear tooth, a cavity in the body, a rack slidable mounted in said cavity, the rack having a forward portion and a rearward portion, the forward portion of the rack having at least one tooth for engagement with said at least one gear tooth of the pinion, means associated with said rack to move said rack to a forward position, biasing means associated with said rack to bias said rack toward its rearward position when said rack is moved to its forward position, means associated with said rack to hold said rack in its forward position, whereby when the rack is moved to its forward biased position said at least one tooth of said rack engages said at least one tooth of said pinion, means for releasing said holding means, whereby when said holding means releases the biasing means forces the rack toward its rearward position, the said one tooth on said rack engages said at least one tooth on said pinion thereby initiating the rotation of said marking wheel.

6. The apparatus as claimed in claim 5 wherein there are means associated with the biasing means for adjusting the biasing force of the biasing means.

7. The apparatus as claimed in claim 5 wherein said pinion and said rack have plural teeth in engagement when said rack is moved.

8. The apparatus as claimed in claim 5 wherein said pinion and said rack have plural teeth in engagement when said rack is moved in each direction and as the rack is moved to its biased position the marking wheel is rotated to its pre-marking position and when the rack is released to move in its biased direction it rotates said marking wheel in its marking direction.

9. The apparatus as claimed in claim 5 wherein said biasing means is a spring.

10. The apparatus as claimed in claim 5 wherein said biasing means is a fluid.

11. The apparatus as claimed in claim 5 wherein said holding means is operated electrically.

12. The apparatus as claimed in claim 5 wherein said holding means is a fluid.

13. The apparatus as claimed in claim 5 wherein said forward moving means is a solenoid.

14. The apparatus as claimed in claim 5 wherein said rearward moving means is a solenoid.

* * * * *